US007717729B2

(12) United States Patent
Zhang et al.

(10) Patent No.: US 7,717,729 B2
(45) Date of Patent: May 18, 2010

(54) ELECTRICAL SOCKET CONNECTOR WITH A LOAD LEVER HAVING SELF-BIASING DEVICE

(75) Inventors: Jie-Feng Zhang, ShenZhen (CN); Wen He, ShenZhen (CN); Yao-Chi Huang, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 113 days.

(21) Appl. No.: 12/009,700

(22) Filed: Jan. 22, 2008

(65) Prior Publication Data

US 2008/0214025 A1 Sep. 4, 2008

(30) Foreign Application Priority Data

Jan. 22, 2007 (CN) ..... 2007 2 0033804 U

(51) Int. Cl.
*H01R 13/62* (2006.01)

(52) U.S. Cl. ..... 439/331

(58) Field of Classification Search ..... 439/73, 439/331, 342
See application file for complete search history.

(56) References Cited

U.S. PATENT DOCUMENTS 6,827,587 B2 * 12/2004 Ma ..... 439/73
7,001,197 B2 * 2/2006 Shirai et al. ..... 439/331
7,101,210 B2 * 9/2006 Lin et al. ..... 439/331

* cited by examiner

*Primary Examiner*—Neil Abrams
(74) *Attorney, Agent, or Firm*—Andrew C. Cheng; Wei Te Chung; Ming Chieh Chang

(57) ABSTRACT

Provided herewith a land grid array socket comprises an insulative housing having a plurality of contacts and a metallic reinforce plate positioned at a bottom surface of the housing. The insulative housing has a top surface for receiving a land grid array package. A cover member is pivotally mounted on a first end of the insulative housing. The cover member is pivotal between an open position and a closed position where the cover member presses the land grid array package toward the top surface of the insulative housing so that the land grid array package electrically connects to the contacts. A lever, with an operating rod, is pivotally mounted on a second end of the insulative housing and has a tilted shaft portion biasing against the second end thereof so as to create a self-biasing elastic force with respect to the reinforce plate so that the lever, when set to a locked position, moves pivotally in a horizontal direction due to the elastic force to tightly engage with a latch of the reinforce plate to assure locking between the lever and the reinforce plate.

7 Claims, 6 Drawing Sheets

ELECTRICAL SOCKET CONNECTOR WITH A LOAD LEVER HAVING SELF-BIASING DEVICE

BACKGROUND OF THE INVENTION

1. Field of the Invention

The present invention relates to an electrical connector assembly for electrically connecting an electronic package such as a land grid array chip to a circuit board, and particularly to an electrical connector assembly with a load lever with self-biasing device. In use, the load lever is automatically biased toward a stiffener ensuring a more reliable engagement with the stiffener when the lever set to a locked position.

2. Description of the Related Art

Land Grid Array socket, has been widely used in personal computer (PC) system for connecting a CPU onto a printed circuit board (PCB), achieving the signal transferring between the CPU and the PCB, such as disclosed in Patent Issued U.S. Pat. No. 7,001,197 issued to Shirai, which teaches a LGA socket has an insulative housing receiving a plurality of contacts therein. A cover member is pivotally mounted on a first end of the insulative housing or a stiffener. The cover member is pivotal rotated between an open position in which the LGA chip can be disposed and a closed position to press the LGA chip toward the hosing. A load lever is pivotally mounted on a second end of the housing. The load lever has a locking portion for locking the cover in the closed position so as to ensure a reliable interconnection between the LGA chip and the connector. A metallic reinforcing plate is positioned on a bottom surface of the housing.

A typical conventional LGA socket 20 is shown in FIGS. 1 and 2. The connector comprises an insulative housing 6, a metal stiffener 7 attached and surrounding the housing 6, a cover 8 pivotally arranged at one side of the stiffener 7, a load lever 9 is pivotally arranged on the other side of the stiffener 7. The housing 6 also defines a plurality of passageways (not show) receiving a plurality of terminals (not show).

The stiffener 7 defines a rectangular cavity in the middle for retaining the housing therein, a first hinge 71 and a second hinge 72 are formed on a first end of the stiffener 7, a connecting end 73 defined on the opposite to the first end, and a locking portion 74 is disposed in a side portion of the stiffener 7 thereof to engage with the arm portion 941 of the load lever 9.

The cover 8 defines a joint portion 81 for connecting with the stiffener 7, a hook 82 extending from the opposite end of the joint portion 81.

The load lever 9 comprising a first axles portion 91 and a second axles portion 92, a pressing portion 93 positioned between the first axles portion 91 and the second axles portion 92, an arm portion 941 generally perpendicularly extending from the second axles portion 92, and an operating portion extending from the distal end of the arm portion 941.

In use, the pressing portion 93 can be pivoted through rotation to the operating portion 942 between horizontal and vertical position. The connector 20 is firstly in an open state with the cover 8 perpendicular to the housing 6 and the pressing portion 93 of the load lever 9 at a highest position. A LGA chip (not show) is then put into the housing 6. Then the connector 20 is in a closed state. The cover 8 is rotated down and abutting the LGA chip. Rotate the load lever 9 with the pressing portion 93 pressing on the hook 82 and the arm portion 941 be locked in the locking portion 74 of the stiffener 7. Thus the LGA chip is stably received in the connector 20.

Because the first axles portion 91 and the second axles portion 92 which received in the first hinge 71 and the second hinge 72 are parallel to the first hinge 71 and the second hinge, gaps are formed between the first axles portion 91 and the first hinge 71, and between the second axles portion and the second hinge during the connect in an open state and in a closed state, thus it is not compact enough between the load lever 9 and the stiffener.

A new electrical connector that overcomes the above-mentioned problem is desired.

SUMMARY OF THE INVENTION

An object of the present invention is to provide a LGA socket with a load lever with self-biasing device. In use, the load lever is automatically biased toward a stiffener ensuring a more reliable engagement.

To fulfill the above-mentioned object, land grid array socket accordance with a preferred embodiment of the present invention comprising an insulative housing, a plurality of terminals received in the insulative housing, a metallic stiffener defining an opening for receiving the housing, a cover member and a load lever are respectively and pivotally mounted to the stiffener. The cover and the load lever are pivotal between an open and a closed position. The load lever with self-biasing device comprises a locking portion disposed between a first axles portion and a second axles portion, and an operational arm perpendicularly extending from the end of the second axles portion. When the load lever and the cover are in a closed position, the locking portion of the load lever pressing on one end of the cover. The self-biasing device causes the arm portion of the load lever automatically biasing toward the stiffener ensuring a reliable engagement.

Other objects, advantages and novel features of the present invention will become more apparent from the following detailed description when taken in conjunction with the accompanying drawings.

DETAILED DESCRIPTION OF PREFERRED EMBODIMENT

Reference will now be made to the drawings to describe the present invention in detail.

Figure 1:
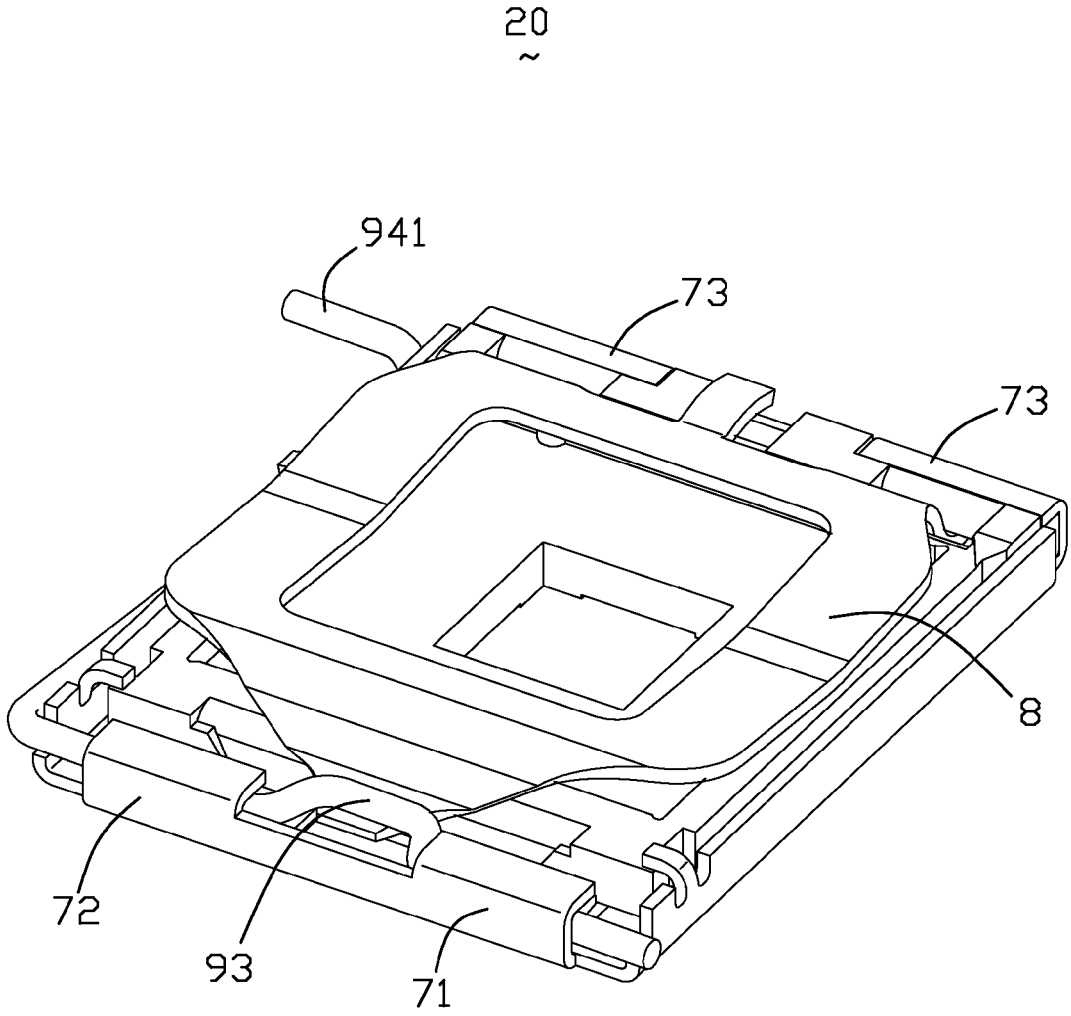
FIG. 1 (PRIOR ART)
FIG. 1 is an assembled, isometric view of a land grid array socket.
Figure 2:
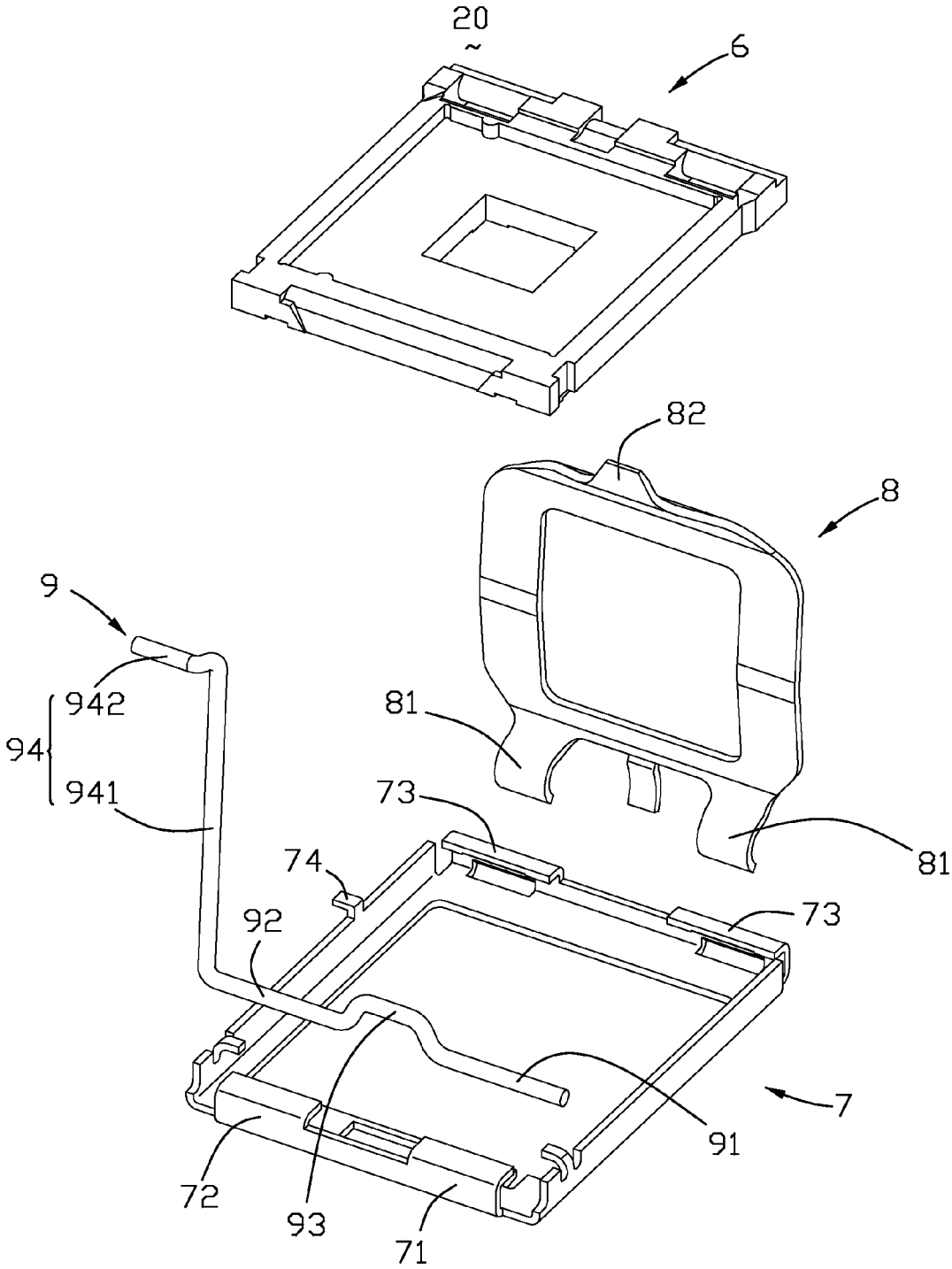
FIG. 2 (PRIOR ART)
FIG. 2 is an exploded view of the land grid array socket FIG. 1.
Figure 3:
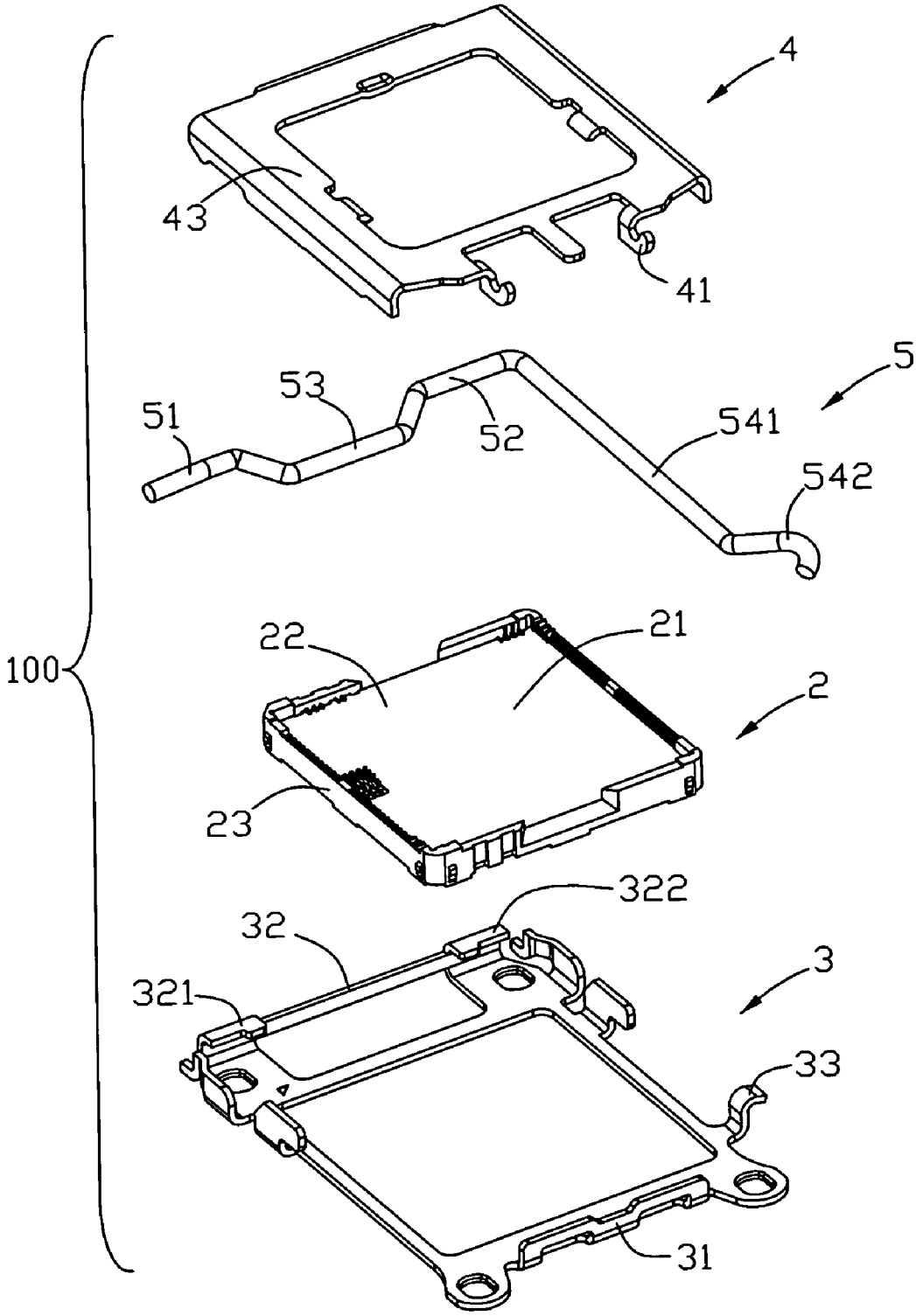
FIG. 3 is an exploded view of a land grid array socket in accordance with the preferred embodiment of present invention.

FIG. 3 shows an exploded, isometric view of a land grid array socket 100 in accordance with a preferred embodiment of the present invention. The LGA socket 100 comprising an insulative housing 2 molded from resin or the like (hereinafter, simply referred to as "housing"). A stiffener 3 defining an opening (not labeled), the housing is positioned in the opening. A cover member 4 is pivotally mounted on a first end 31 of the stiffener 3. A load lever 5 is pivotally arranged on a second end 32 of the stiffener 3.

The individual elements of the LGA socket 100 will now be described in greater detail. The housing 2 is shaped in the form of a rectangular. A mating surface 22 is defined for mating a LGA package (not show). Conducting region 21 is defined in the center of the mating surface 22 receiving a plurality of terminals (not shown). Peripheral walls 23 extending upwardly from edges of the housing 2.

The stiffener 3 for reinforcing the housing 2 defines a first end 31, and the first end 31 defining a pair of pivot aperture (not labeled) to engage with the cover 4. A second end 32 is defined on the opposite of the first end 31. The second end 32 comprising a first hinge 321 and a second hinge 322 for receiving the load lever 5. A locking portion 33 is formed in a side portion (not labeled) between the first end 31 and the second end 32.

The cover member 4 is generally rectangular shape defining a generally rectangular frame 43. A pair of engaging portions 41 is defined in one end of the cover 4 for engaging with the stiffener 3, a hook 42 extending from the frame 43 on the opposite end to the engaging potions 41.

The load lever 5 is formed by bending a single metallic wire and comprises a first axles portion 51 and a second axles portion 52. A pressing portion 53 located between the first axles portion 51 and the axles portion 52. The load lever 5 also has an arm portion 541 generally perpendicularly extending from the second axles portion 52 and an operational portion 542 extending and formed at the distal end of arm portion 541. The load lever 5 has a self-biasing device at the first axles portion 51 and formed at an angle against to the second axles portion 52. A protrusion 511 is formed on the first axles portion 51.

Figure 4:
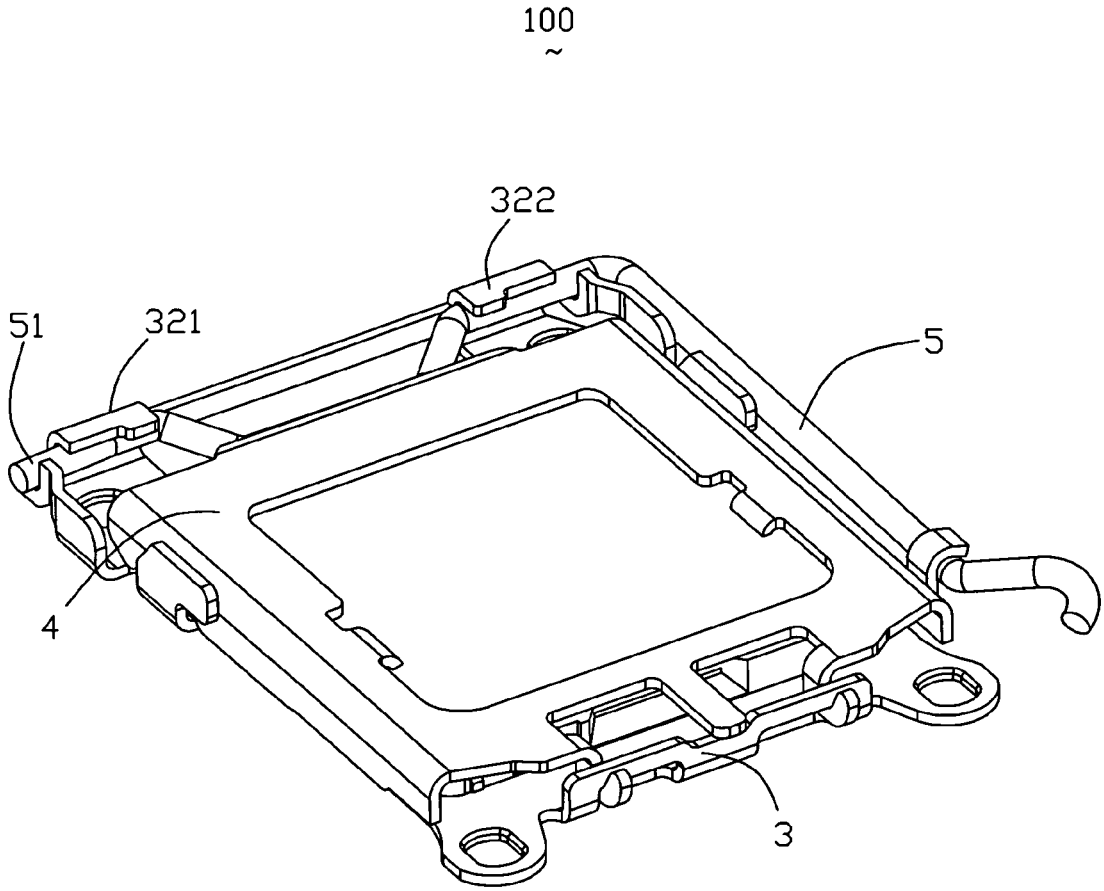
FIG. 4 is an assembled view of the land grid array socket of FIG. 3.
Figure 5:
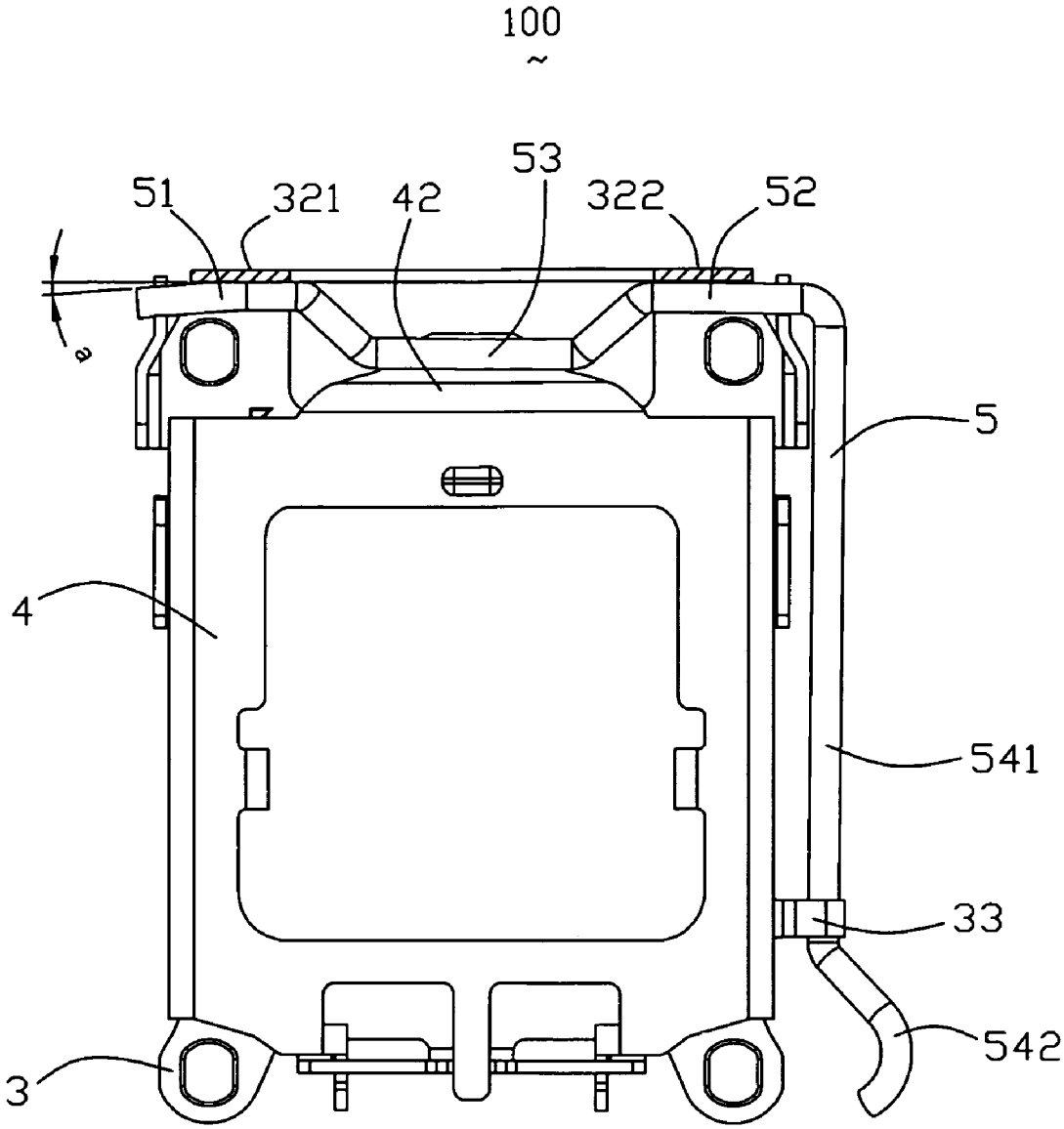
FIG. 5 is a plan, section view of the land grid array socket of FIG. 3.
Figure 6:
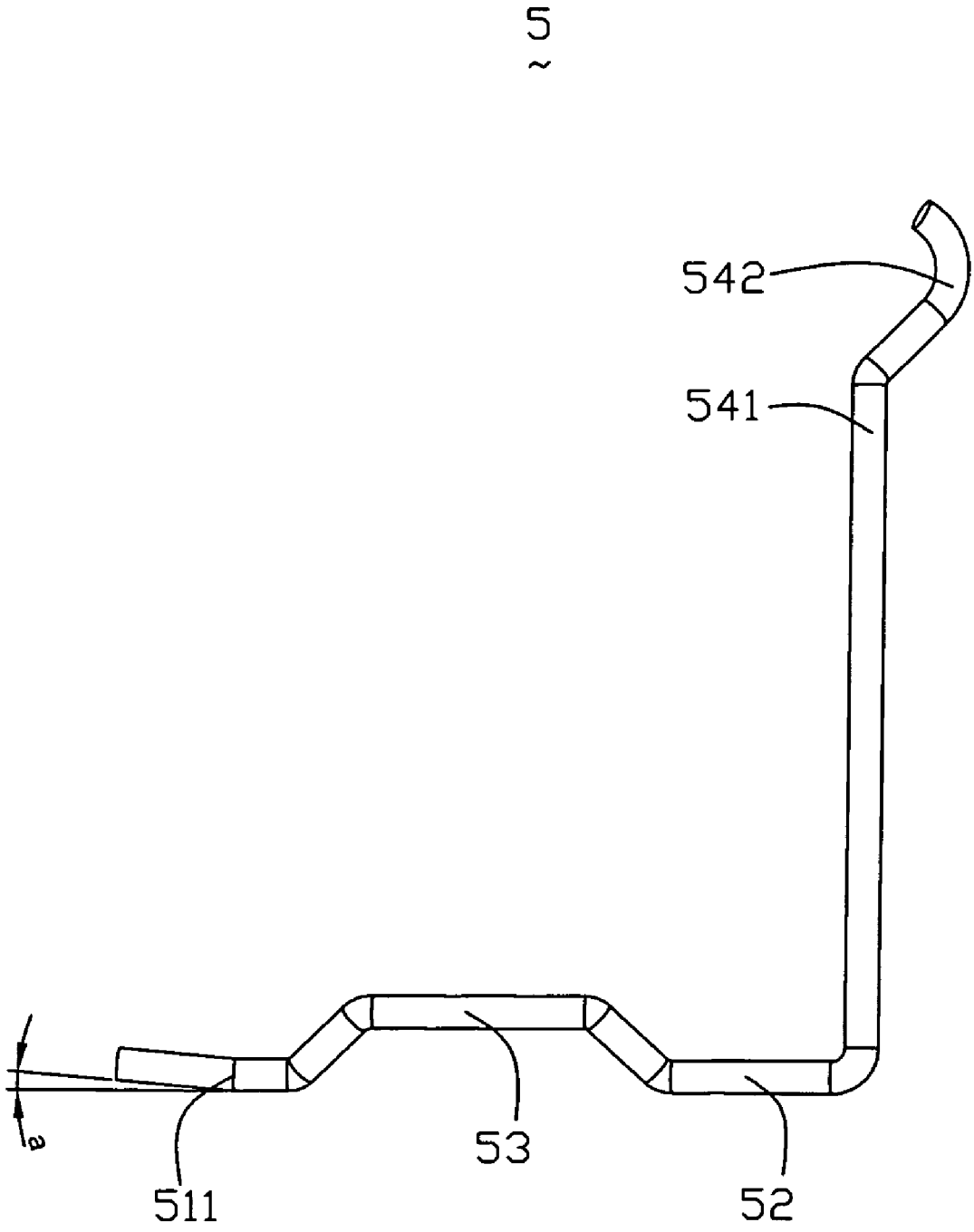
FIG. 6 is a plan view of the load lever of land grid array socket of FIG. 3.

Referring to FIGS. 3-5, in assembly process, the terminals are pre-loaded within the insulative housing 2. The insulative housing 2 is then positioned in the opening of the stiffener 3. The cover 4 is pivotably mounted to the first end 31 of the stiffener 3. The load lever 5 is pivotably arranged in the second end 32 with the first axles portion 51 and the second axles portion 52 respectively received in the first hinge 321 and the second hinge 322. The cover 4 and the load lever 5 are firstly in an open state, the LGA package is put onto the mating surface 22 of the housing 2. When the cover 4 is closed, the pressing portion 53 pressing on the hook 42, the arm portion 541 is engaged with the locking portion 33 of the stiffener 3. During rotating the load lever 5 and hooking the arm portion 541 in the locking portion 541, the protrusion 511 compactly attach on the first hinge 321 of the stiffener, and causing internal-stress between the protrusion 511 and the first hinge 321. The internal-stress making the arm portion 541 biasing toward the stiffener. Thus, the self-biasing device of the load lever 5 ensuring more reliable engagement between the load lever 5 and the land grid array socket 100.

Because the load lever 5 biasing towards stiffener 3 when the LGA socket is in a closed state, it causing stress between the arm portion 541 and the locking portion 33 to make more compactly connection.

Although the present invention has been described with reference to a particular embodiment, it is not to be construed as being limited thereto. Various alterations and modifications can be made to the embodiment without in any way departing from the scope or spirit of the present invention as defined in the appended claims.

What is claimed is:

1. A land grid array socket, comprising:

an insulative housing equipped with a plurality of contacts, the insulative housing having a top surface for receiving a land grid array package;

a metallic reinforcing plate mounted on a bottom surface of the insulative housing;

a cover member pivotally mounted on a first end of the metallic reinforcing plate, the cover member being pivotal between an open position and a closed position where the cover member presses the land grid array package toward the top surface of the insulative housing so that the land grid array electrically connects to the contacts; and a lever having a shaft portion with opposite first and second end sections thereof and essentially defining a first axle pivotally mounted on a second end of the metallic reinforcing plate, opposite to the first end of the metallic reinforcing plate, wherein said lever is rotated about the first axle with regard to the reinforcing plate, and an operating arm portion unitarily extending from the first end section of the shaft portion in essentially a perpendicular manner, said shaft portion further equipped, at the second end section, with an abutment section essentially offset from the first axle so as to be forcibly engaged with the reinforcing plate to create a self-biasing force with respect to the reinforcing plate and thus urge the operating arm laterally and inwardly toward the reinforcing plate for assuring locking between the lever and the reinforcing plate when a locking portion formed on the operating arm of the lever locks the cover member in the closed position.

2. The land grid array socket as claimed in claim 1, wherein the abutment section essentially defines a second axle which is tilted with regard to the first axle with an angle.

3. The land grid array socket as claimed in claim 2, wherein the second axle is forcibly engaged with a side wall of the reinforcing plate.

4. A land grid array socket, comprising:

an insulative housing having a plurality of contacts, the insulative housing having a top surface for receiving a land grid array package;

a metallic reinforcing plate mounted on a bottom surface of the insulative housing and having a hinge arrangement with an extended section extending upwardly from the metallic reinforcing plate;

a cover member pivotally mounted on a first end of the metallic reinforcing plate, the cover member being pivotal between an open position and a closed position where the cover member presses the land grid array package toward the top surface of the insulative housing so that land grid array package electrically connects to the contacts; and a lever attached with the metallic reforming plate via the hinge arrangement, the lever having an angled free end which doesn't engage the extended section of the metallic reforming plate when the lever is disposed in a vertical position while coming to abut against the extended section when the lever is rotated to a horizontal position and thereby deforming to provide a proper elastic force to the lever.

5. The land grid array socket as claimed in claim 4, wherein the lever is made with an "L" shape comprising a lateral part extending along a second end of the reinforcing plate opposite to the first end and a longitude part substantially perpendicular to the lateral part, the lateral part comprising an offset section located at a middle position thereof and two shafts at opposite sides of the offset section for engaging the hinge arrangement respectively, the angled free end being formed on one of the two shafts so that the two shafts are not in a same line.

6. A land grid array socket, comprising:

an insulative housing having a plurality of contacts, the insulative housing having a top surface for receiving a land grid array package;

a metallic reinforcing plate mounted on a bottom surface of the insulative housing and having an extended section extending upwardly therefrom;

a cover member pivotally mounted on a first end of the metallic reinforcing plate, the cover member being pivotal between an open position and a closed position where the cover member presses the land grid array package toward the top surface of the insulative housing so that land grid array package electrically connects to the contacts; and a L-shaped lever attached with the metallic reforming plate and having a pressing rod located at a second end of the reinforcing plate opposite to said first end and an operating rod substantially perpendicular to the pressing rod and located at a third end of the reinforcing plate, the free end of the pressing rod being configured with a bended section;

wherein when the lever is disposed into a horizontal position where the operating rod is locked by a latch in the third end of the reinforcing plate, the bended section rotates toward the extended section and then abuts against the extended section and thereby deforming to produce a proper elastic force, so that the whole lever moves pivotally in a horizontal direction due to the elastic force and causes the operating rod to tightly engage with the latch of the reinforcing plate.

7. The land grid array socket as claimed in claim 6, wherein the pressing rod comprises an offset section located at a middle position thereof and two shafts at opposite sides of the offset section, the bended section being formed on one of the two shafts so that the two shafts are not in a same line.

* * * * *